US012768131B2

(12) United States Patent
Vahling et al.

(10) Patent No.: US 12,768,131 B2
(45) Date of Patent: Oct. 20, 2026

(54) MOTOR GRADER QUICK CHANGE WORK ATTACHMENT

(71) Applicant: Caterpillar Inc., Peoria, IL (US)

(72) Inventors: Bruce Raymond Vahling, Urbana, IL (US); Nathaniel K. Harshman, Sullivan, IL (US); Benjamin J. Kovalick, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 414 days.

(21) Appl. No.: 18/503,867

(22) Filed: Nov. 7, 2023

(65) Prior Publication Data

US 2025/0146250 A1 May 8, 2025

(51) Int. Cl.
*E02F 3/815* (2006.01)
*E02F 3/76* (2006.01)

(52) U.S. Cl.
CPC ..... *E02F 3/8152* (2013.01); *E02F 3/764* (2013.01)

(58) Field of Classification Search
CPC ..... E02F 3/76; E02F 3/7663; E02F 3/7636; E02F 3/764; E02F 3/8152
USPC ..... 172/781, 795, 796
See application file for complete search history.

(56) References Cited

U.S. PATENT DOCUMENTS

| | | | | |
|---|---|---|---|---|
| 7,198,687 | B2 * | 4/2007 | Hill, III | E02F 3/8152 156/130.5 |
| 10,458,081 | B2 | 10/2019 | Hayes et al. | |
| 2012/0260537 | A1 * | 10/2012 | Winter | E01H 5/061 37/270 |
| 2018/0073215 | A1 | 3/2018 | Wells, Jr. et al. | |
| 2019/0276999 | A1 * | 9/2019 | Holman | E01H 5/062 |

FOREIGN PATENT DOCUMENTS

| | | | |
|---|---|---|---|
| CA | 2099799 | A1 | 1/1994 |
| CN | 111254998 | B | 12/2021 |

* cited by examiner

*Primary Examiner* — Christopher J Sebesta
*Assistant Examiner* — Evan A Bregel

(57) ABSTRACT

A work attachment for a work machine is disclosed. The work attachment has a moldboard that has moldboard apertures and moldboard fasteners along its bottom surface. The work attachment also has a clamp bar having its own set of apertures to receive the moldboard fasteners for attaching the clamp bar to the moldboard. The clamp bar slides around the moldboard fasteners, along a longitudinal axis of the moldboard, from an open position to a closed position to attach a cutting edge to the moldboard.

20 Claims, 6 Drawing Sheets

MOTOR GRADER QUICK CHANGE WORK ATTACHMENT

TECHNICAL FIELD

The present disclosure generally relates to a work attachment associated with a motor grader.

BACKGROUND

Motor graders include a work attachment that is mounted between a pair of front wheels and a pair of rear wheels of the motor grader. The work attachment includes a moldboard that is coupled to a Drawbar-Circle-Moldboard (DCM) assembly of the motor grader. When a motor grader is used for a work operation, such as a grading operation, the motor grader typically moves quickly with the moldboard forcing against a ground surface or in float. A cutting edge of the moldboard can become worn, or damaged, from scraping the ground surface or contacting objects such as debris. Typically, the worn cutting edge on a moldboard needs to be replaced which is a time consuming process that involves manually undoing many mechanical fasteners, such as bolts, screw, rivets, or the like, which attach the moldboard to the cutting edge.

U.S. Pat. No. 10,458,081 discloses a work attachment for a motor grader. According to the reference, a work plate is attached to the grader by the help of mechanical fasteners. Mechanical fasteners are disclosed as to be a bolt, a screw, a rivet, a pin, etc. that the user can remove for replacing the plates. A trip edge assembly having a pivoting mechanism is used to lessen physical damage to a cutting edge by allowing the cutting edge to pivot when an object is struck by the cutting edge.

While effective, there remains a need for improved work attachment designs for work machines used in high wear applications, such as construction and mining.

SUMMARY

In accordance with one aspect of the present disclosure, a work attachment for a work machine is disclosed. The work attachment has a moldboard that includes a plurality of moldboard apertures and a plurality of moldboard fasteners that extend from a bottom portion of a surface of the moldboard. The work attachment also has a clamp bar that has a first set of clamp bar apertures and a plurality of wedge structures on a surface of the clamp bar. Each moldboard fastener extends through their respective clamp bar aperture for connecting the clamp bar to the moldboard. When connected, the clamp bar is able to slide along a longitudinal axis of the moldboard from an open position to a closed position.

In accordance with another aspect of the present disclosure, a clamp bar for attaching a cutting edge to a moldboard is disclosed. The clamp has an oblong shaped aperture that receives a moldboard fastener attached to a bottom portion of the moldboard for attaching the clamp bar to the moldboard. When attached, the clamp bar is able to slide in an axial plane of the moldboard to an open position from a closed position. The clamp bar also has a second clamp bar aperture that has a first radius portion and a second radius portion, with the first radius portion having a larger radius than the second. The first radius portion is used to receive a cutting edge fastener of a cutting edge, after the cutting edge fastener first passes through a moldboard aperture, for attaching the cutting edge to the moldboard. The clamp bar further has a wedge structure that is used to slide under a head portion of the cutting edge fastener when the clamp bar is slid to the closed position.

In accordance with another aspect of the present disclosure, a motor grader that has a frame, a drawbar-circle moldboard system coupled to the frame, and a work attachment coupled to the drawbar-circle moldboard system. The work attachment includes a moldboard that has moldboard aperture and a moldboard fastener used to attach a clamp bar to the moldboard. The moldboard fastener extends from a bottom portion of a surface of the moldboard. The clamp bar has an oblong shaped clamp bar aperture that surrounds the moldboard aperture when the moldboard fastener when the clamp bar is attached. The clamp bar also has a wedge structure on a surface of the clamp bar, and the clamp bar is able to slide along the longitudinal axis of the moldboard to an open position from a closed position.

These and other aspects and features of the present disclosure will be more readily understood when read in conjunction with the accompanying drawings.

DETAILED DESCRIPTION

Figure 1:
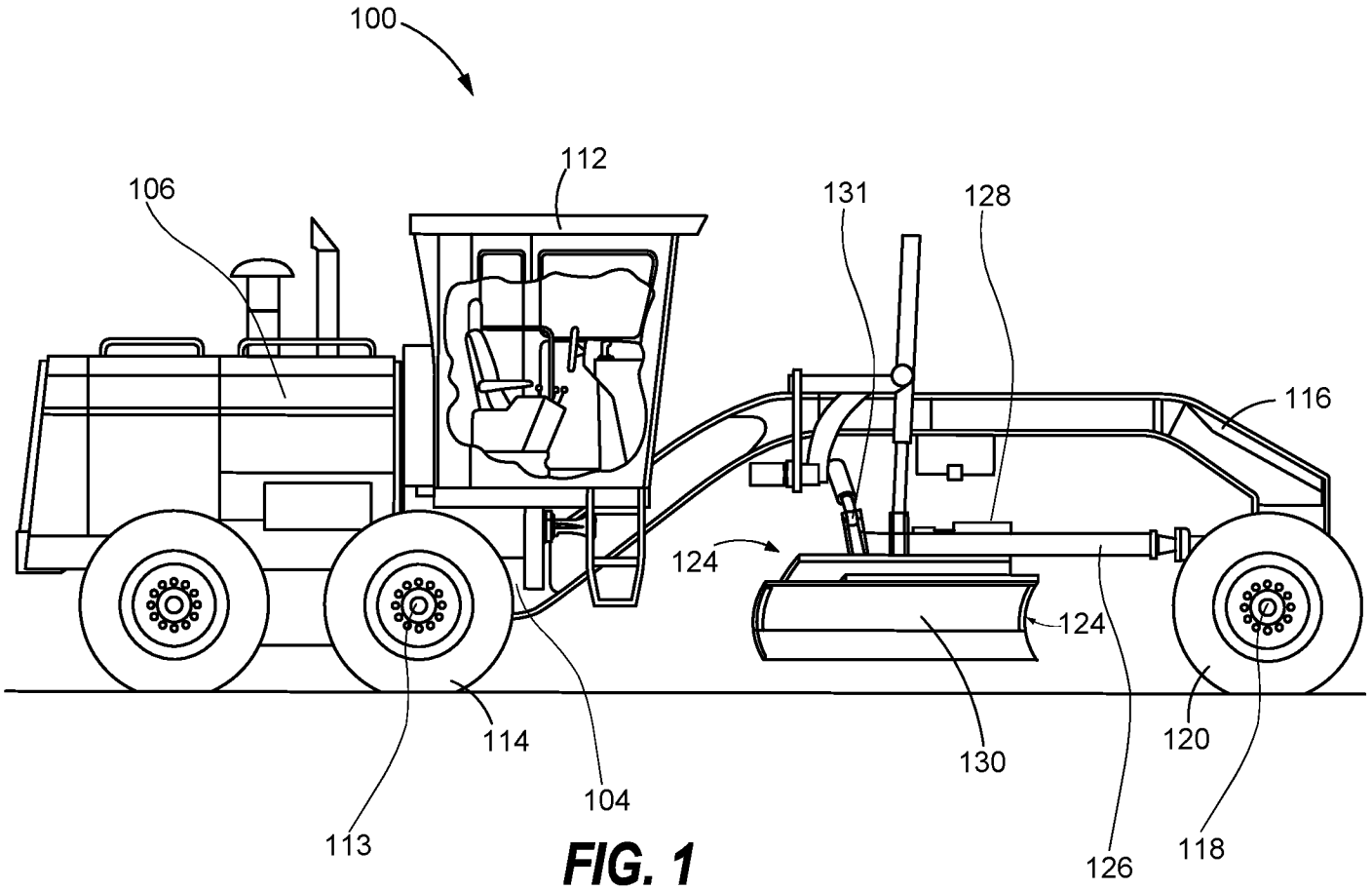
FIG. 1 is a diagrammatic illustration of a work machine having a work attachment.

Referring to FIG. 1, a side elevation view of a motor grader 100, according to an embodiment of the present disclosure, is shown. The motor grader 100 may be used to flatten uneven ground surfaces such as during a grading process prior to road construction, moving of snow, debris, and so on. The motor grader 100 includes a main frame 104. The main frame 104 supports various components of the motor grader 100 such as an engine 106, an operator cabin 112, one or more rear axels 113, and rear wheels 114. The motor grader 100 also includes a front frame 116 coupled to the main frame 104. The front frame 116 support a steerable front axle 118 and front wheels 120, which provide steering to the motor grader 100 on the ground surface.

The front frame 116 also supports a work attachment 124. The work attachment 124 may be used to perform work operations, such as grading or now removal. The work attachment 124 is positioned between the rear wheels 114 and the front wheels 120. More particularly, the work attachment 124 is supported by a drawbar 126 and a circle 128 of a Drawbar-Circle-Moldboard (DCM) assembly 129.

The drawbar 126 and the circle 128 are coupled to the front frame 116. Further, the work attachment 124 includes a moldboard 130 and one or more hydraulic cylinders 131 to support or move the moldboard 130. The moldboard 130 is curved, such as plow shaped, and extends along a longitudinal axis AA to allow for the plowing, or removal, or snow, debris, or the like.

Figure 2:
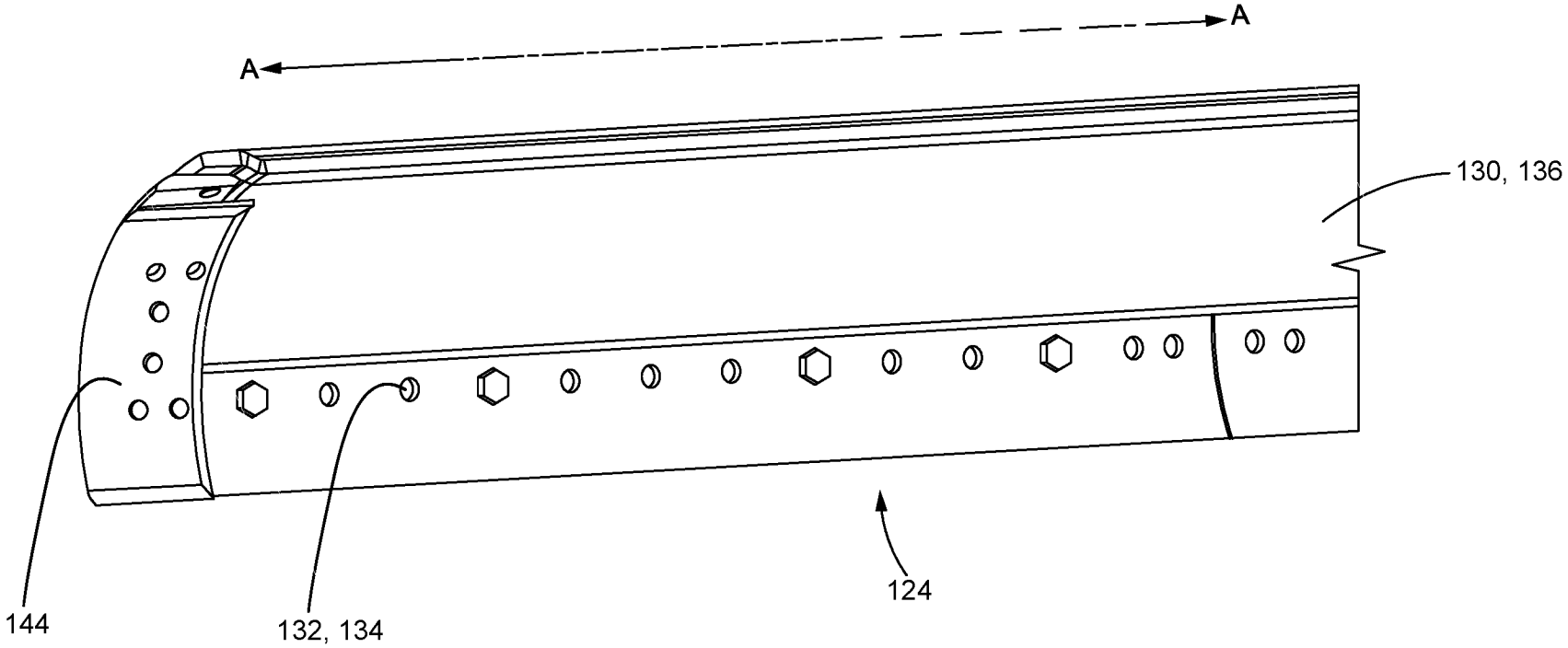
FIG. 2 is a front perspective view of an exemplary work attachment associated with the work machine of FIG. 1, in accordance with the present disclosure.

Referring to FIG. 2, a front perspective view of the work attachment 124 is illustrated. The moldboard 130 includes a plurality of moldboard apertures 132 (shown more clearly in FIGS. 6-7), that are depicted as being overlayed, or aligned with, a plurality of corresponding cutting edge apertures 134 (shown more clearly in FIGS. 6-7) of a cutting edge 135. The cutting edge 135 is used for scraping the ground surface during a work operation and is attached to a front surface 136 of the moldboard 130, and, for example, at a bottom end (also referred to as the bottom portion) 138 of the moldboard 130 at the front surface 136. The moldboard 130 may have a recessed attachment portion 140, with respect to the curvature of the moldboard 130, that initially curves away from the direction of the curvature of the moldboard 130 prior to curving in the same direction (direction of curvature of the moldboard), for overlaying a top end 142 of the cutting edge 135 when attaching the cutting edge 135.

Figure 3:
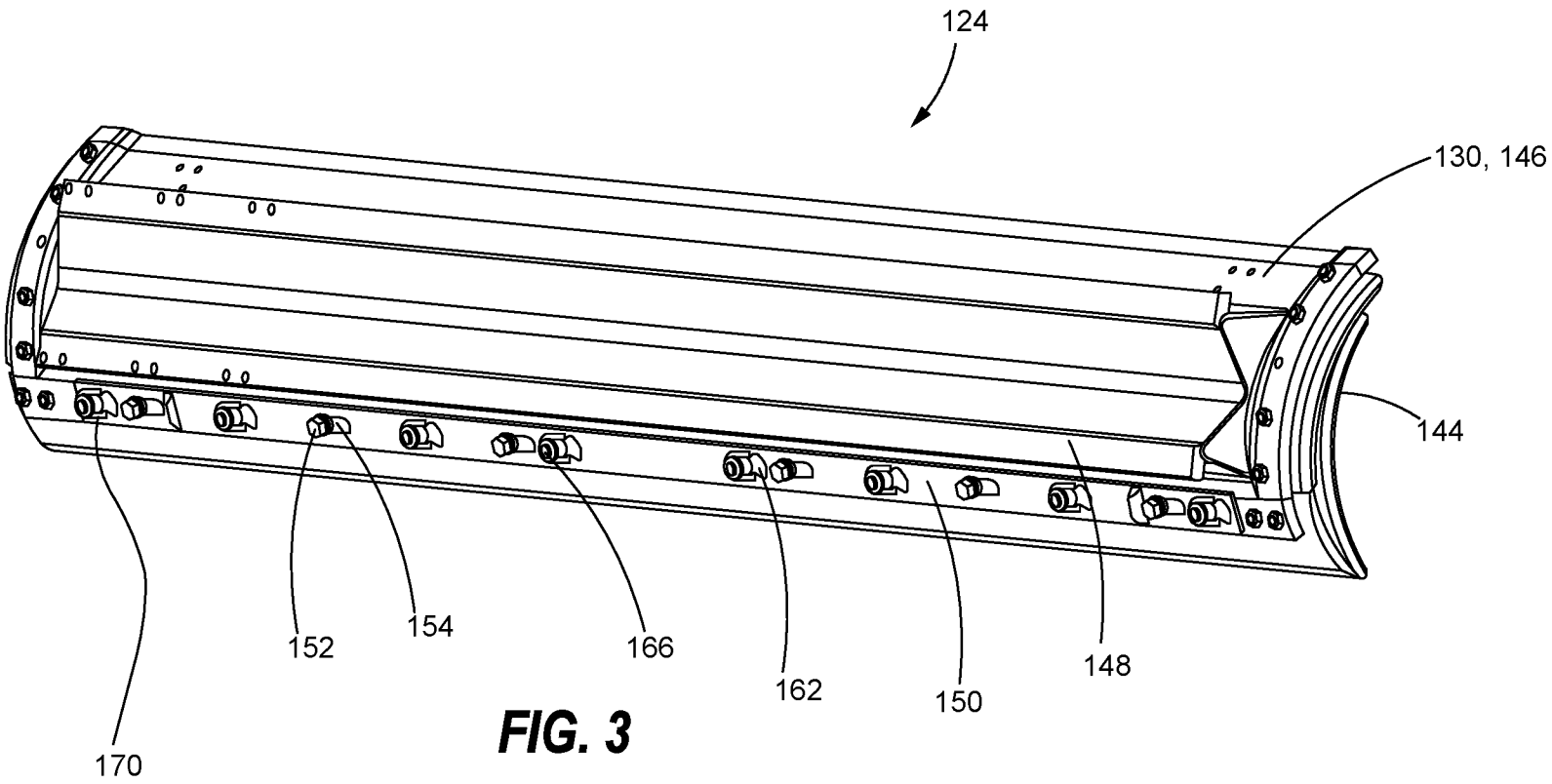
FIG. 3 is rear perspective view of the work attachment of FIG. 2, in accordance with the present disclosure.
Figure 4:
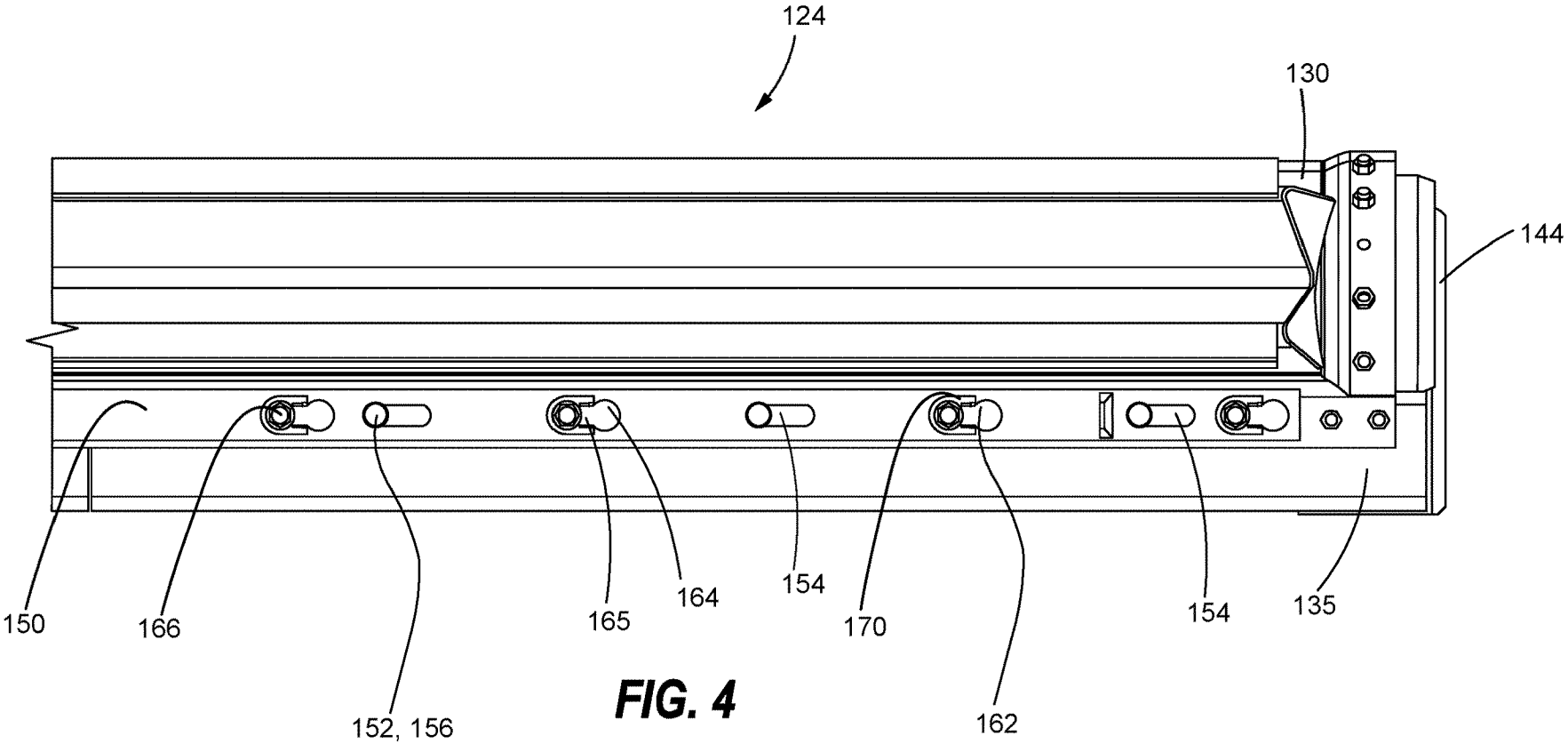
FIG. 4 is rear view of the work attachment of FIG. 2, in accordance with the present disclosure.

As best shown in FIGS. 2-4, the work attachment 124 may have side wear plates 144 that are attached to the work attachment 144 to reduce wear on the sides of the work attachment 124, and, for example, to reduce wear on the sides of the moldboard 130 during any work operations. The side wear plates 144, as shown FIG. 2, may overlap both the moldboard 130 and the cutting edge 135 from a front view perspective.

Turning to FIG. 3, a rear view of the work attachment 124 is shown. As shown, attached to a rear surface 146 of the moldboard 130, the work attachment 124 may also have an attachment assembly 148 for attaching the work attachment 124 to the work machine 100, and, for example, for attaching the work attachment 124 to the drawbar 126, circle 128, and/or hydraulic cylinders 131 of the DCM 129.

Figure 5:
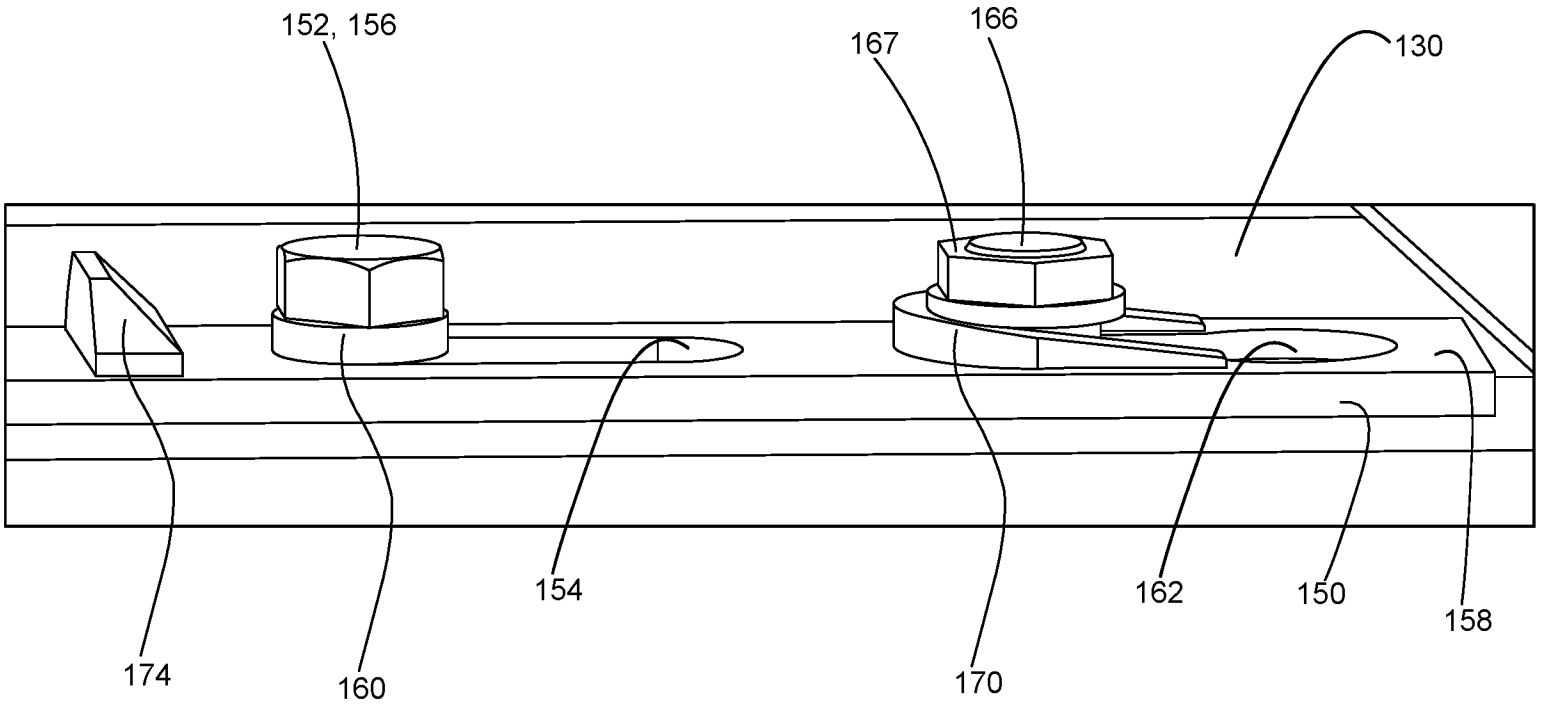
FIG. 5 is a partial view of a clamp bar attached to the work attachment of FIG. 2, in accordance with the present disclosure.

For attaching a clamp bar 150, attached to the rear surface 146 of the moldboard 130 at the bottom portion 138, may be a plurality of moldboard fasteners 152. The moldboard fasteners 152, such as bolts or the like, may be attached to the moldboard 130 by welding, are screwed into the moldboard 130, or completely extend through the moldboard 130 for attachment by a nut on both sides of the moldboard 130 (not shown), extend away from the rear surface 146 of the moldboard. The clamp bar 150 has a first set of clamp bar apertures 154 through which the moldboard fasteners 152 are extended through, such that each clamp bar aperture 152 of the first set of clamp bar apertures 152 surrounds their respective moldboard fastener 152 when the clamp bar 150 is attached. Each moldboard fastener 152 has a smaller diameter, or width, than a diameter, or width, of the clamp bar apertures 154 to allow for the insertion of the moldboard fastener 152 through the clamp bar apertures 154. Once inserted through, the clamp bar fasteners 152 are topped with a stopgap 156, as shown in FIG. 5, such as a nut or the end of a bolt, that has a larger diameter, or width, than the clamp bar apertures 154 to prevent the clamp bar 150 from sliding off of the moldboard fasteners 152 to keep the clamp bar 150 attached to moldboard 130. Between the stopgap 156 and a top surface 158 of the clamp bar 158 may be a washer 160, or other device, to distribute the load from the moldboard fasteners on the top surface 158 and prevent any damage to said top surface 158.

The clamp bar apertures 154 may have an oblong, or oval, shape as depicted in FIG. 5. This oblong shape allows for the sliding of the clamp bar 150 along the rear surface 146 of the moldboard 130 back in forth along the longitudinal axis AA. Thus, the clamp bar may slide in one direction until the moldboard is prevented from sliding further due to contact with a first side 162 (FIG. 5) of the clamp bar aperture 154 and slide in the opposite direction along the longitudinal axis AA until the clamp bar 150 contacts the opposite second side 164 of the clamp bar aperture 154. The clamp bar 150, as discussed below, is slidable from an open and a closed position, and prior to moving to the closed position, the clamp bar 150 may be moveable laterally, with respect to the longitudinal axis (tangent to the longitudinal axis), along the moldboard fastener 152 between the moldboard 130 rear surface 146 and the stop gap 156.

For attaching the cutting edge 135 to the moldboard 130, the clamp bar has a second set of apertures 162, depicted in FIG. 5, that have a different shape than the first set of apertures 154. The second set of clamp bar apertures 162 has a key shape, having a first aperture portion 164 that has a first radius, and a second aperture portion 165 that has a second radius that is smaller than the radius of the first aperture portion 165.

Figure 6:
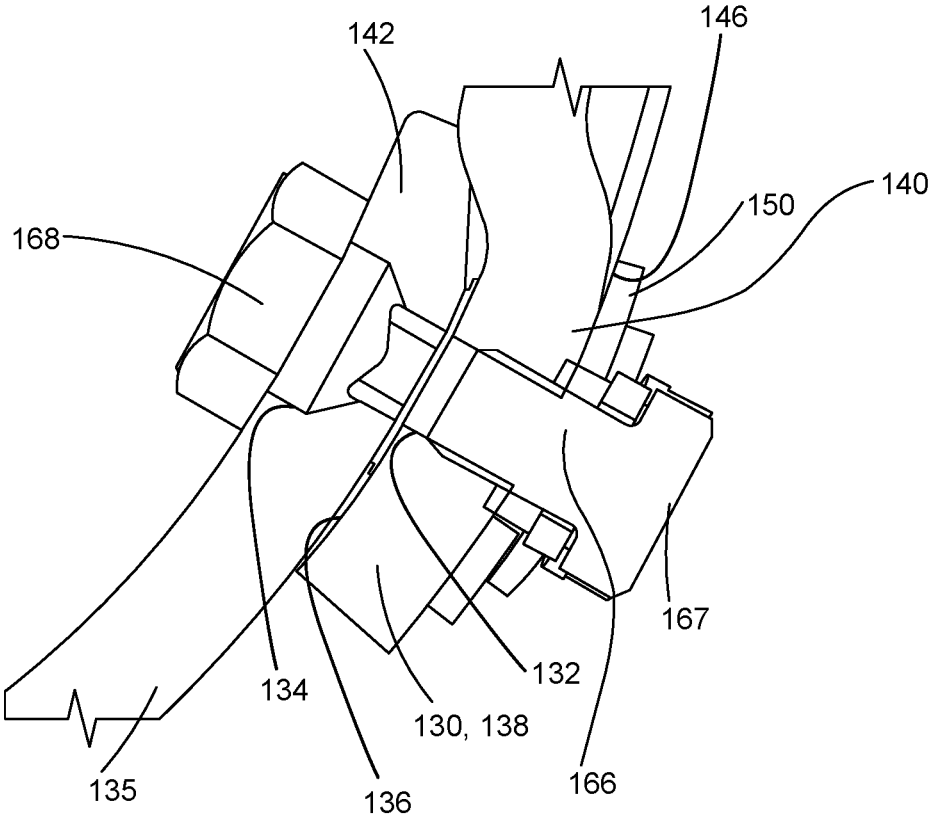
FIG. 6 is a side view of a lateral end portion of a moldboard of the work attachment of FIG. 2 having a cutting edge attached by a cutting edge fastener, in accordance with the present disclosure.
Figure 7:
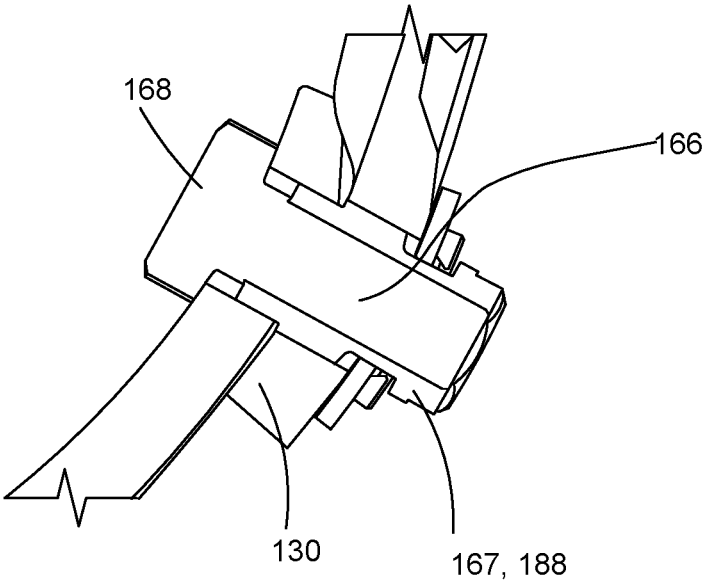
FIG. 7 is a side view of a lateral end portion of the moldboard of the work attachment of FIG. 2 having the cutting edge attached by another exemplary embodiment of the cutting edge fastener of FIG. 6, in accordance with the present disclosure.

Further for attaching the cutting edge 135, as shown in FIGS. 6-7, the cutting edge 135 has a plurality of cutting edge fasteners 166 that are inserted through the cutting edge apertures 134. The cutting edge fasteners 166 have a first head 167, or stopgap such as a nut, on a first side of the cutting edge fastener 166 and a second head 168, or stopgap such as a nut, on a second side of the cutting edge fastener. The cutting edge first and second heads 167, 168 prevent the cutting edge fasteners 166 from falling completely through cutting edge apertures 134 as they have a larger diameter, or radius, than the diameter or radius than the cutting edge apertures 134. In a further exemplary embodiment, the cutting edge fasteners 166 are attached to the cutting edge by welding, or screwed into, the cutting edge 135 such that only the first head 167 is required.

For quickly attaching the cutting edge 135, the cutting edge fasteners 166 are first inserted through their respective moldboard apertures 132. After passing through the moldboard apertures 132, the first head 167 of the cutting edge fasteners 166 then passes through the first aperture portion 164 of their respective second clamp bar aperture 162 of the second set of clamp bar apertures 162. Thus, the first head 167 has a smaller radius, or diameter, than the radius or diameter of the both the moldboard apertures 132 and the first aperture portions 164 of the second set of clamp bar apertures 162. Once the first head 167 has passed through the moldboard aperture 132 and the second clamp bar aperture 162, the clamp bar 150 is slide along the longitudinal axis from the open position to the closed position to securely attach the cutting edge 135 to the moldboard 130.

The clamp bar 150 also has a plurality of wedge structures 170 attached on its top surface 158. The wedge structures have a wedge, or diameter or radius, which is smaller than any width, diameter, or radius, of the first head 167 of the cutting edge fastener, but a larger width, diameter, or radius than a shaft 172 of the cutting edge fasteners. The wedge structures 170 are U shaped that surround the second aperture portion 165 of each of the second clamp bar apertures 162. The wedge structures have a height that increases, relative to the top surface 158 of the clamp bar 150, as the wedge structure moves away from the first aperture portions 164 of the second clamp bar apertures 162. As the clamp bar 150 is slid to the closed position, each wedge structure 170 is slid underneath each of their first heads 167 of each cutting edge fastener 166. Thus, a shaft 172 of each of the cutting edge fasteners 166 goes from being surrounded by the first aperture portion 164 to being surrounded by the second aperture portion 165 as the clamp bar 150 is slid to the closed position, and due to the increasing height of the wedge structures 170, the clamp bar 150 becomes securely attached to the moldboard 130. To put it another way, the increasing height of the wedge structures 170 is equal to, or greater than, any remaining shaft 172 length of the cutting edge fasteners 166 that is not surrounded by their respective apertures of the moldboard 130 or the clamp bar 150 such than no remaining slack is left to allow the cutting edge fastener 166 to slid, and the cutting edge fastener 166 is under tension between the wedge structure 170 and the second head 168 (or from the cutting edge 135 if no second head 168 is present).

For removing the cutting edge 135, the clamp bar 150 is slid back to the open position, and the wedge structure 170 is slid from underneath and away from the first head 135 of the cutting edge fastener 166. The first head 167 is then allowed to freely pass through the first aperture portion 164 and the moldboard aperture 132 to remove the cutting edge 135 from the moldboard 130.

The clamp bar 150 may further have a handle 174 extending from the top surface 158 of the clamp bar 150. This handle allows a user to push/pull the clamp bar 150 to the open and closed positions. The handle, in another exemplary embodiment may further act as a hitting point for a blunt object, such as a hammer, to tighten the system to drive the wedge structures 170 underneath the first heads 167 of the cutting edge fasteners 166.

FIG. 7 depicts another exemplary embodiment of the cutting edge fastener 166 is inserted into a sleeve 188 that is first inserted into the moldboard aperture 132 and/or cutting edge aperture 134. The sleeve may form the first head 167, in one embodiment, or may act as a bolt sleeve/spacer in another embodiment.

Although the present figures depict the clamp bar 150 attached to the rear surface 146 of the moldboard 130, it is to be understood that the present invention further encompasses the attachment of the clamp bar to the front of the moldboard 130, or work attachment 124, as well. In an exemplary embodiment where the clamp bar 150 is attached to the front, the entire process above is reversed, and the cutting edge 135 may be attached from the rear of the moldboard 130 rather than the front.

INDUSTRIAL APPLICABILITY

In general, the teachings of the present disclosure may find applicability in many industries including, but not limited to, motor graders. For example, the teachings of the present disclosure may find applicability in any industry using moldboards to flatten or smooth, or for debris removal, on a ground surface.

The present disclosure relates to a work attachment that has moldboard 130 having a clamp bar 150. As the moldboard 130 design disclosed herein allows the clamp bar 150 to slide from open to closed positions to quickly remove and attach cutting edge 135, the amount of downtime caused from wear and tear of the cutting edge 135 may be reduced. For example, changing of the cutting edge 135 does not require manual removal of any fastener devices.

The work attachment design provides a solution for limiting impact of the cutting edge 135 with objects present in a drive path of the motor grader 100. Also, the clamp bar 150 disclosed herein can be retrofitted on an existing work implement without modification of the existing work implement. Further, the cutting edge 135 can be easily coupled with the work attachment 124 in the field by simply sliding the clamp bar 150 in a longitudinal direction, with respect to the moldboard 130.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A work attachment for a work machine, comprising:

a moldboard having a plurality of moldboard apertures and a plurality of moldboard fasteners extending from a bottom portion of a surface of the moldboard; and a clamp bar having a first set of clamp bar apertures, a second set of clamp bar apertures, and a plurality of wedge structures on a surface of the clamp bar, each wedge structure being disposed adjacent to a respective clamp bar aperture of the second set of clamp bar apertures, and each moldboard fastener of the plurality of moldboard fasteners extending through a respective clamp bar aperture of the first set of clamp bar apertures to couple the clamp bar to the moldboard;

wherein, when the clamp bar is coupled to the moldboard, the second set of clamp bar apertures and the plurality of wedge structures are configured to enable the clamp bar to slide along a longitudinal axis of the moldboard between an open position and a closed position.

2. The work attachment of claim 1, wherein the second set of clamp bar apertures have a different shape than the first set of clamp bar apertures.

3. The work attachment of claim 2, wherein the work attachment includes a cutting edge, the cutting edge includes a plurality of cutting edge fasteners, and the cutting edge is configured to be removably coupled to the moldboard when the cutting edge fasteners are inserted through the plurality of moldboard apertures and the second set of clamp bar apertures.

4. The work attachment of claim 3, wherein the cutting edge is configured to be securely attached to the moldboard after the cutting edge fasteners are inserted through the plurality of moldboard apertures and the second set of clamp bar apertures, and after the clamp bar is slid to the closed position.

5. The work attachment of claim 4, wherein the cutting edge is configured to be removable from the moldboard when the clamp bar is slid to the open position.

6. The work attachment of claim 3, wherein each aperture of the second set of clamp bar apertures has a first aperture portion and a second aperture portion, the first aperture portion having a greater radius than the second aperture portion.

7. The work attachment of claim 6, wherein each cutting edge fastener of the plurality of cutting edge fasteners is configured to be inserted through the first aperture portion of a corresponding aperture of the second set of clamp bar apertures when attaching the cutting edge to the moldboard.

8. The work attachment of claim 7, wherein each wedge structure of the plurality of wedge structures is configured to slide under a head portion of a corresponding cutting edge fastener of the plurality of cutting edge fasteners as the clamp bar is slid to the closed position.

9. The work attachment of claim 8, wherein each cutting edge fastener includes the head portion and a shaft portion, the head and shaft portions being configured to be inserted through corresponding moldboard apertures and clamp bar apertures of the second set of clamp bar apertures when attaching the cutting edge to the moldboard.

10. The work attachment of claim 9, wherein the head portion of the cutting edge fastener has a larger diameter than the second aperture portion of each aperture of the second set of clamp bar apertures.

11. A clamp bar for attaching a cutting edge to a moldboard, the clamp bar comprising:

a first clamp bar aperture having an oblong shape, the first clamp bar aperture configured to receive a moldboard fastener attached to a bottom portion of a clamp bar engaging side of the moldboard to slidably attach the clamp bar to the moldboard, the clamp bar slidable along a longitudinal axis of the moldboard to an open and a closed position;

a second clamp bar aperture having a first radius portion and a second radius portion, the first radius portion having a larger radius than the second radius portion, the first radius portion configured to receive a cutting edge fastener attached to the cutting edge after the cutting edge fastener is first received through a moldboard aperture on the bottom portion of the moldboard; and a wedge structure configured to slide under a head portion of the cutting edge fastener when the clamp bar is slid to the closed position.

12. The clamp bar of claim 11, wherein the wedge structure is U-shaped and partially surrounds the second radius portion of the second clamp bar aperture.

13. The clamp bar of claim 12, wherein the second radius portion of the second clamp bar aperture has a smaller radius than the head portion of the cutting edge fastener.

14. The clamp bar of claim 13, wherein the wedge structure is tapered and gradually increases in height, relative to a top surface of the clamp bar, as the wedge structure moves away from the first radius portion of the second clamp bar aperture.

15. The clamp bar of claim 11, wherein the cutting edge fastener is removably attached to the cutting edge.

16. The clamp bar of claim 11, wherein the clamp bar has a handle that protrudes away from the clamp bar perpendicular to the longitudinal axis.

17. A motor grader comprising:

a frame;

a drawbar-circle moldboard assembly coupled to the frame; and a work attachment coupled to the drawbar-circle moldboard assembly, the work attachment comprising:

a moldboard having a moldboard fastener for coupling a clamp bar to the moldboard, wherein the moldboard fastener extends from a bottom portion of a surface of the moldboard, and wherein the moldboard defines a moldboard aperture, the clamp bar coupled to the moldboard at the bottom portion, wherein the clamp bar has an oblong shaped clamp bar aperture surrounding the moldboard aperture when the clamp bar is coupled to the moldboard, and a wedge structure on a surface of the clamp bar, wherein the clamp bar is configured to be slidable along the longitudinal axis of the moldboard to an open position and a closed position.

18. The motor grader of claim 17, wherein the moldboard fastener has a stopgap to prevent the clamp bar aperture from sliding off, laterally with respect to the longitudinal axis, the moldboard fastener.

19. The motor grader of claim 17, wherein the moldboard fastener is detachably connected to the moldboard.

20. The motor grader of claim 17, wherein the clamp bar is configured to slidably move to the closed position for attaching a cutting edge to the moldboard.

* * * * *